United States Patent [19]

Kikuchi et al.

[11] Patent Number: 4,711,707

[45] Date of Patent: Dec. 8, 1987

[54] METHOD FOR REMOVAL OF SCALE FROM HOT ROLLED STEEL

[75] Inventors: Kaoru Kikuchi, Ibaraki; Nobuo Shikata, Tokyo, both of Japan

[73] Assignees: Agency of Industrial Science & Technology; Ministry of International Trade & Industry, both of Tokyo, Japan

[21] Appl. No.: 3,821

[22] Filed: Jan. 16, 1987

[30] Foreign Application Priority Data

Jan. 17, 1986 [JP] Japan ..... 61-8624

[51] Int. Cl.[4] ..... C25F 1/06

[52] U.S. Cl. ..... 204/145 R

[58] Field of Search ..... 204/144.5, 145 R

[56] References Cited

U.S. PATENT DOCUMENTS 4,129,485 12/1978 Shikata ..... 204/145 R
4,276,133 6/1981 Nagano ..... 204/145 R
4,363,709 12/1982 Zaremski ..... 204/145 R

*Primary Examiner*—T. M. Tufariello
*Attorney, Agent, or Firm*—Oblon, Fisher, Spivak, McClelland, & Maier

[57] ABSTRACT

The scale formed on stainless steel during the course of hot rolling is removed quickly and perfectly by subjecting the scale-covered steel to anode electrolysis in an aqueous sodium sulfate solution and subsequently to anode electrolysis in an aqueous sodium chloride solution.

4 Claims, 14 Drawing Figures

METHOD FOR REMOVAL OF SCALE FROM HOT ROLLED STEEL

FIELD OF THE INVENTION AND RELATED ART STATEMENT

This invention relates to a method for removal of the scale formed on a stainless steel such as SUS 304 steel and SUS 430 steel during the hot rolling of the steel.

Heretofore, the removal of the scale from stainless band steel has been generally carried out by the pickling method using a strong acid such as hydrochloric acid, sulfuric acid, nitric acid, and hydrofluoric acid either independently of each other or as combined suitably. The scale formed on the stainless steel has the composition and structure thereof varied by differences in the conditions of heat treatment during the process of manufacture. When the conditions of pickling for the scale removal are not suitable for the composition of the scale being removed, for example, there ensue difficult problems such as protraction of the time required for the scale removal, excessive dissolutive loss of the metal being stripped of the scale, and imperfect scale removal. Further since the pickling relies on the solution by a strong acid, it entails a problem of degrading the working environment. Moreover, disposal of the spent acid and the effluent from the pickling system, a huge investment on equipment is required for.

In addition, U.S. Pat. No. 4,129,485 discloses a method for removing ferrosoferric oxide scale from hot rolled steel plate by first using the plate as the cathod in electrolysis carried out in sodium chloride electrolyte and then reversing the cathode and anode in the electrolysis. This method aims at removing scale composed predominantly of ferrosoferric oxide and not containing chromium oxide. The type of scale to be removed thus differs from that of the present invention.

OBJECT AND SUMMARY OF THE INVENTION

An object of this invention is to provide a method for quick removal of the scale formed on stainless steel such as SUS 304 steel or SUS 430 steel during the hot rolling thereof, with inhibition of the dissolutive loss of the underlying metal.

Another object of this invention is to provide a method for the removal of the scale from stainless steel such that the waste liquid from the treatment can be disposed of easily compared with that involved when the scale removal is effected by the conventional pickling technique.

To accomplish the objects of this invention described above, there is provided a method for the removal of the scale formed on stainless steel during the process of the hot rolling thereof, which method comprises subjecting the stainless steel covered with the scale first to anodic electrolysis in an aqueous 5 to 20% sodium sulfate solution at a current density in the range of 0.2 to 1.2 $A/cm^2$ and subsequently to anodic electrolysis in an aqueous 5 to 20% sodium chloride solution at a current density in the range of 0.3 to 0.5 $A/cm^2$.

In the aforementioned method for scale removal, since the speed of the scale removal can be easily controlled by the current density, the optimum speed of scale removal can be selected in due consideration of the dissolutive loss of the metal under treatment and the speed of treatment.

Further, since the treatment for scale removal is effected using aqueous solutions of neutral salts, the waste liquid from the treatment can be disposed of easily.

The above and other objects and features of the invention will become more apparent from the following detailed description with reference to the accompanying drawings.

DETAILED DESCRIPTION OF THE PREFERRED EMBODIMENT

Figure 1A:
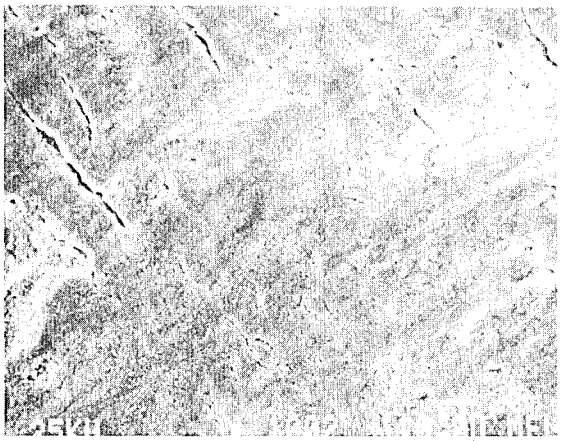
FIG. 1(A) is a photograph of the surface of scale formed on stainless steel taken through a microscope at 1,000 magnifications.
Figure 1B:
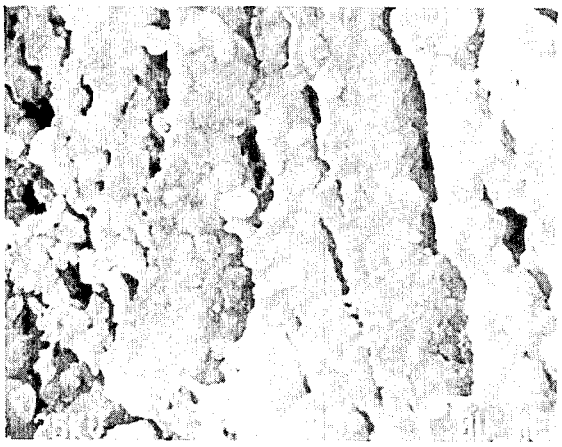
FIG. 1(B) is a photograph of the same scale taken through a microscope at 10,000 magnifications.
Figure 1C:
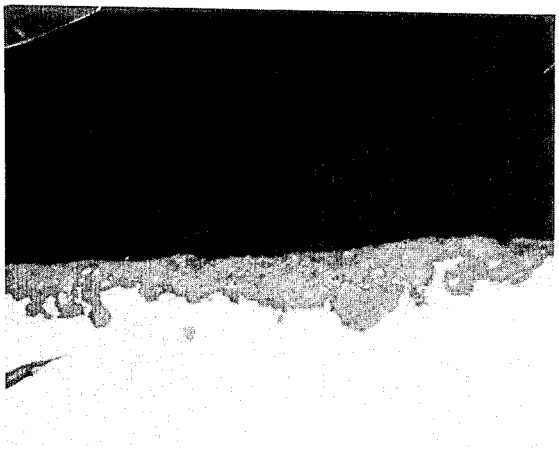
FIG. 1(C) is a photograph of a cross section of the same scale taken through a microscope at 300 magnifications.

During the process of hot rolling in the manufacture of stainless steel sheet such as stainless steel sheet of the grade of SUS 304 steel or SUS 430 steel, the stainless steel sheet is generally rolled at about 1,100° C. and then taken up in a roll at about 800° C. During the aforementioned process, the stainless steel forms scale on the surface thereof so long as the hot rolling is carried out in the open air. FIG. 1(A) is a photograph of the scale formed on stainless steel SUS 304 at 1,000 magnifications, FIG. 1(B) is a photograph of the same scale at 10,000 magnifications, and FIG. 1(C) is a photograph of a cross section of the same scale at 300 magnifications.

The scale shown in these photographs, on test for composition by the X-ray diffraction, was found to contain magnetite ($Fe_3O_4$), wustite (FeO), and chromium sesquioxide ($Cr_2O_3$).

A study was continued in search of a method capable of efficient removal of the scale of this composition. It has been consequently found that when a steel sheet covered with scale is used as an anode and an electrode opposed thereto is used as a cathode in an aqueous 5 to 20% sodium sulfate solution to effect anodic electrolysis, the soluble oxide forming the scale layer is dissolved and removed and, as the result, the linkage of the scale layer to the underlying metal is weaked and, at the same time, the scale layer sustains cracks and other similar defects due to removal of the oxide.

Subsequently, the steel sheet is subjected to anodic electrolysis in an aqueous 5 to 20% sodium chloride solution. During this anodic electrolysis, the $Cl^-$ ion breaks the scale, finds its way through the aforementioned defects into the interface between the scale layer and the underlying metal, and dissolves the underlying metal to induce separation and removal of the scale layer.

Suitably the current density of the electrolysis is in the range of 0.2 to 1.2 A/cm$^2$ in the former treatment performed in the aqueous sodium sulfate solution and in the range of 0.3 to 0.5 A/cm$^2$ in the latter treatment performed in the aqueous sodium chloride solution.

The time for electrolysis is related closely to the current density and the concentration of the aqueous solution. For the purpose of decreasing the time for electrolysis, it is necessary to heighten proportionately the current density and the concentration of the aqueous solution. Generally, the time for electrolysis is suitably 30 seconds where the current density and/or the concentration of the aqueous solution are near the upper limits of the aforementioned ranges or 60 seconds where they are near the lower limits of the ranges. It should be properly decided with due consideration paid to such factors as the amount of scale and the temperature. Any excessive elongation of the time for electrolysis proves to be undesirable economically because it merely entails wasteful consumption of electric power and dissolutive loss of the underlying metal.

In either of the electrolytic treatments, the electrolytic solution temperature is suitably in the range of 20° C. to 80° C. Particularly when this temperature is in the neighborhood of 50° C., the removal of the scale can be effected at the lowest current density.

Figure 2:
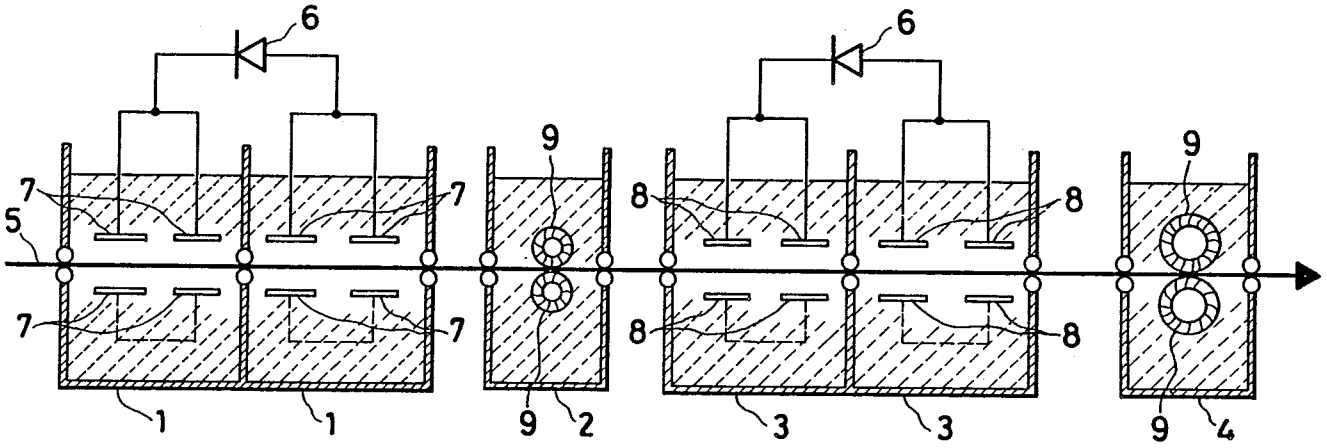
FIG. 2 is a structural diagram of a typical apparatus used in working the method of this invention for the removal of scale formed on stainless steel.

FIG. 2 illustrates one embodiment of apparatus used for working the present invention. In the drawing, 1 stands for an electrolytic cell for an aqueous sodium sulfate solution, 3 for an electrolytic cell for an aqueous sodium chloride solution, and 2 and 4 each for a tank for water washing, and 6 for a power source.

A hot rolled band steel 5 covered with scale is first fed into a space intervening between electrodes 7 such as of stainless steel in the electrolytic cell 1 filled with an aqueous sodium solution to effect anodic electrolysis and dissolve and remove soluble oxide forming the scale layer. Then, the band steel 5 is forwarded to the water washing tank 2, there to be scrubbed with brushes 9. Subsequently, it is passed between electrodes 8 in the electrolytic cell 3 filled with an aqueous sodium chloride solution to effect anodic electrolysis again, with the result that the scale layer is broken by the $Cl^-$ ion, then the underlying metal is dissolved and then the scale layer is separated from the band steel. The band steel 5 which has been stripped of the scale as described above is again scrubbed with brushes 9 in the water washing tank 4 and forwarded to the next step.

Now, this invention will be described below with reference to an example. A hot rolled steel sheet (20 mm×20 mm) of SUS 304 covered with scale of the composition containing $Fe_3O_4$, FeO, and $Cr_2O_3$, was descaled, one test specimen in an aqueous sodium sulfate solution and another in an aqueous sodium chloride solution.

The conditions for the treatment in the aqueous sodium sulfate were 20% of electrolytic solution concentration, 50° C. of solution temperature, 0.4 A/cm$^2$ of current density, and 60 seconds of time of electrolysis.

Figure 3A:
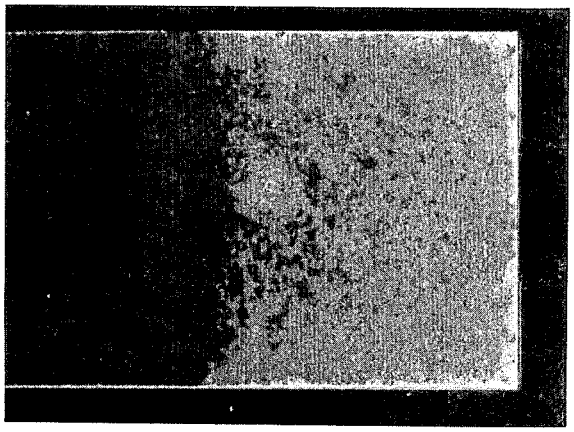
FIG. 3(A) is a photograph of the surface of rolled steel which was covered with scale during the process of hot rolling and which was stripped of the scale by electrolysis in an aqueous sodium sulfate solution, taken through a microscope at 2 magnifications.
Figure 3B:
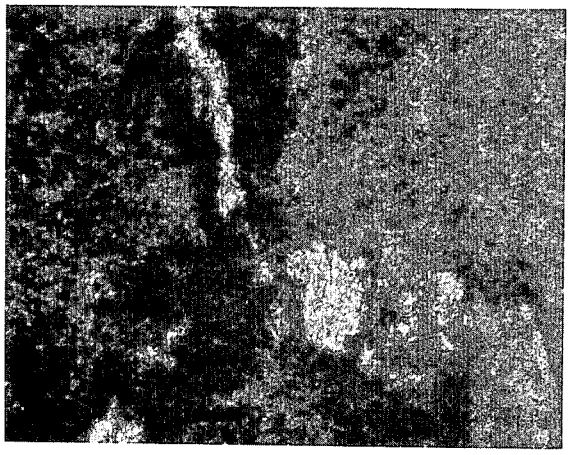
FIG. 3(B) is a photograph of the surface of the treated rolled steel, taken through a microscope at 300 magnifications.

FIG. 3 is a photograph of the surface of the SUS 304 steel after the electrolytic treatment under the aforementioned conditions, taken through a microscope; FIG. 3(A) at 2 magnifications and FIG. 3(B) at 300 magnifications respectively.

It is noted from FIG. 3 that the removal of scale only by the electrolysis in the aqueous sodium sulfate solution was not perfect.

The conditions for the treatment in the aqueous sodium chloride solution were 20% of electrolytic solution concentration, 50° C. of solution temperature, 0.4 A/cm$^2$ of current density, and 60 seconds of time of electrolysis.

Figure 4A:
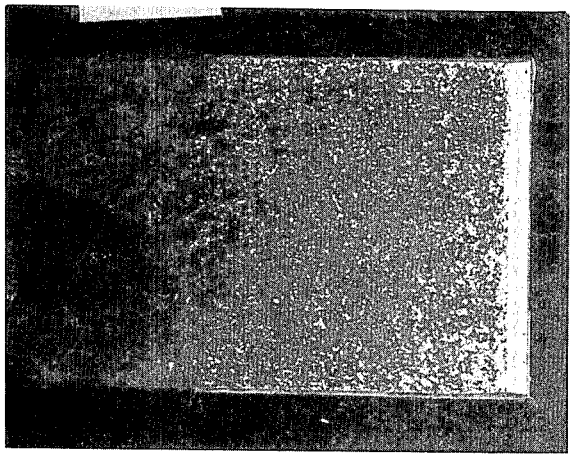
FIG. 4(A) is a photograph of the surface of rolled steel which was covered with scale during the process of hot rolling and which was stripped of the scale by electrolysis in an aqueous sodium chloride solution, taken through a microscope at 2 magnifications.
Figure 4B:
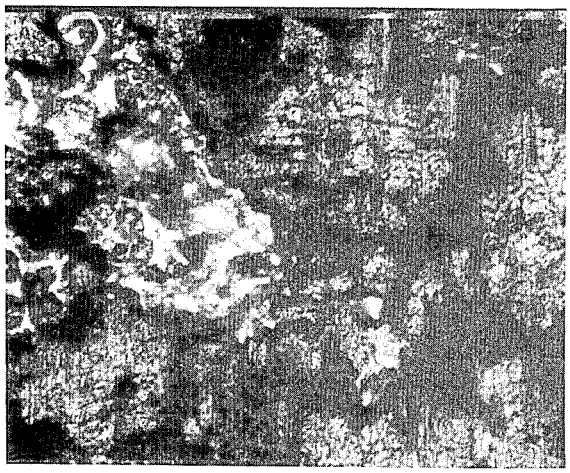
FIG. 4(B) is a photograph of the surface of the treated rolled steel, taken through a microscope at 300 magnifications.

FIG. 4 is a photograph of the SUS 304 steel after the electrolytic treatment under the aforementioned conditions taken through a microscope; FIG. 4(A) at 2 magnifications and FIG. 4(B) at 300 magnifications. Similarly to FIG. 3, FIG. 4 shows that the removal of scale was not perfect.

Then, removal of scale from the aforementioned rolled steel was carried out by reversing the procedure of the method of this invention, namely by first carrying out the anode electrolysis in the aqueous sodium chloride solution and then the anode electrolysis in the aqueous sodium sulfate solution. The conditions of the electrolysis were the same as those of the test run the results of which are illustrated in FIG. 3 and FIG. 4.

Figure 5A:
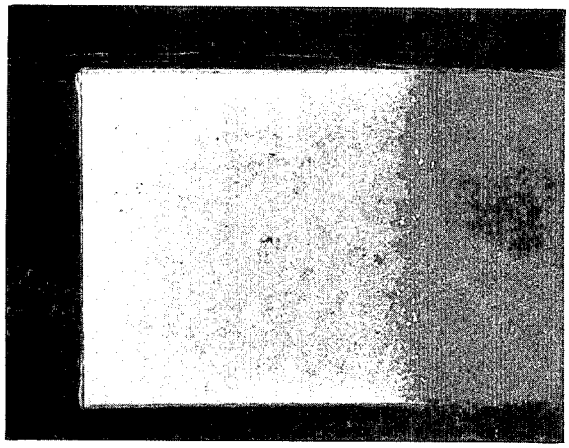
FIG. 5(A) is a photograph of the surface of rolled steel which was covered with scale during the process of hot rolling and which was stripped of the scale by electrolysis in an aqueous sodium chloride solution and subsequent electrolysis in an aqueous sodium sulfate solution, taken through a microscope at 2 magnifications.
Figure 5B:
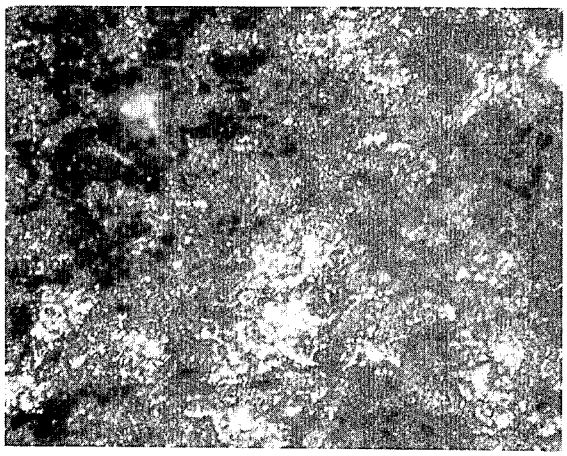
FIG. 5(B) is a photograph of the surface of the treated rolled steel, taken through a microscope at 300 magnifications.

FIG. 5 is a photograph of the surface of the SUS 304 steel treated under the aforementioned conditions, taken through a microscope; FIG. 5(A) at 2 magnifications and FIG. 5(B) at 300 magnifications. It is noted from FIG. 5 that virtually no removal of the scale was obtained by the treatment.

Then, removal of scale from the aforementioned rolled steel was conducted by effecting the first anodic electrolysis in the aqueous sodium sulfate solution and the last anodic electrolysis in the aqueous sodium chloride solution. In this case, the current density in the aqueous sodium sulfate solution was varied in the range of 0.2 to 1.2 A/cm$^2$ and the current density in the aqueous sodium chloride solution in the range of 0.1 to 0.6 A/cm$^2$ with the other conditions equal to those of the foregoing test run.

Figure 6:
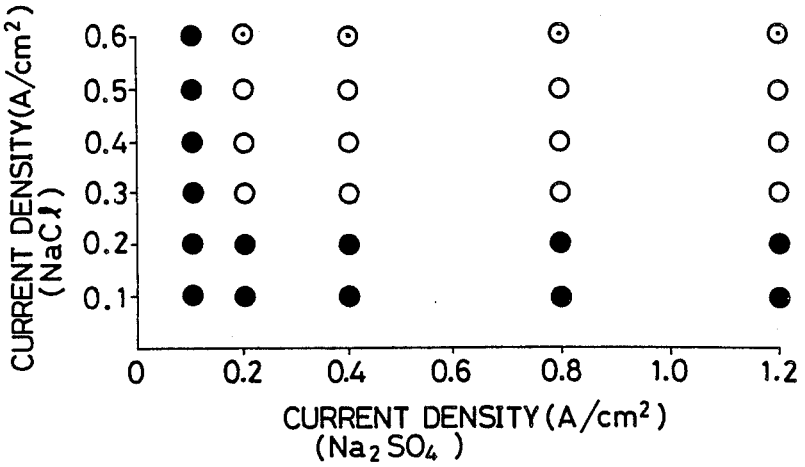
FIG. 6 is a graph showing the relation between the current density of an aqueous sodium sulfate solution, the current density of an aqueous sodium chloride solution, and the condition of scale removal.

The results were as shown in FIG. 6. In the graph of FIG. 6, the horizontal axis is the scale of the current density in the aqueous sodium sulfate solution and the vertical axis the scale of the current density in the aqueous sodium chloride solution, the filled circle (●) denotes imperfect scale removal, the empty circle (○) desirable scale removal, and the double circle (◎) dissolved surface of the underlying metal. It is noted from FIG. 6 that the optimum scale removal was obtained at a current density in the range of 0.2 to 1.2 A/cm$^2$ in the aqueous sodium sulfate solution and in the range of 0.3 to 0.5 A/cm$^2$ in the aqueous sodium chloride solution.

Figure 7B:
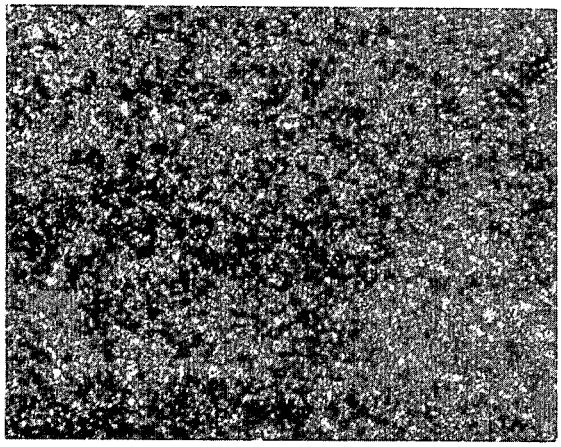
FIG. 7(B) is a photograph of the surface of rolled steel treated similarly, taken through a microscope at 300 magnifications.
Figure 7A:
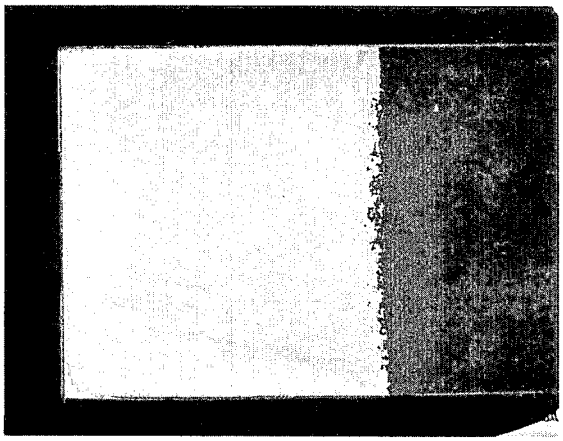
FIG. 7(A) is a photograph of the surface of rolled steel treated by the method of the present invention, taken through a microscope at 2 magnifications.

FIG. 7 is a photograph of the SUS 304 steel treated under the conditions of 0.4 A/cm$^2$ of current density in the aqueous sodium sulfate solution and 0.4 A/cm$^2$ of current density in the aqueous sodium chloride solution, taken through a microscope; FIG. 7(A) at 2 magnifications and FIG. 7(B) at 300 magnifications. It is noted from the photograph that perfect removal of scale was obtained by this treatment.

Then, for the purpose of studying the effect of the electrolytic solution temperature upon the removal of scale, the temperatures of the electrolytic solutions used in the two electrolytic treatments were equally varied in the range of 20° C. to 80° C. and, during the electrolysis in the aqueous sodium sulfate solution, the time for electrolysis was fixed at 60 seconds and the current density was varied in the range of 0.1 to 1.2 A/cm$^2$ and, during the subsequent electrolysis in the aqueous sodium chloride solution, the time for electrolysis was fixed at 60 seconds and the current density was fixed at 0.4 A/cm$^2$.

Figure 8:
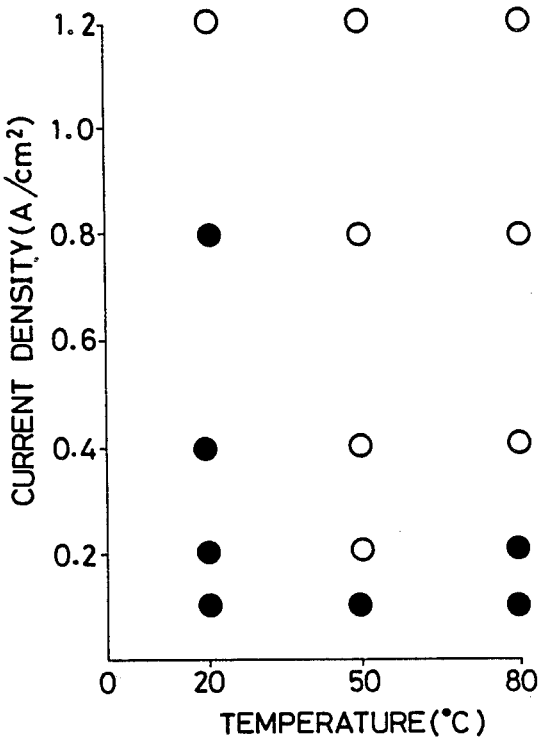
FIG. 8 is a graph showing the relation between the temperature of electrolytic solution and the removal of scale.

The results were as shown in FIG. 8. In the graph of FIG. 8, the longitudinal axis is the scale for the current density in the aqueous sodium sulfate solution and the horizontal axis the scale for the temperature of the electrolytic solution. It is noted from this graph that perfect removal of scale could not be obtained when the temperature of the electrolytic solution was either too low or too high and that the optimum removal of scale was obtained at electrolytic solution temperatures in the range of 20° C. to 80° C. It was confirmed that when the solution temperature was in the neighborhood of 50° C., perfect removal of scale could be obtained at the lowest current density. This particular temperature behavior of the scale is presumably because the reaction causing dissolution of the scale is repressed when the temperature is low and, as the temperature of the electrolytic solution rises, part of the electric current for use in the electrolysis is consumed in the anode oxidation and the removal of the scale, therefore, cannot be carried out to perfection. By the present invention which is constructed as described above, the following effects are attained.

(i) The loss through scale removal can be decreased. Particularly in the case of the stainless steel, SUS 304, which contains such noble metals as chromium and nickel in large amounts, the decrease in the loss through removal of scale is highly effective from the economic point of view and from the standpoint of saving of natural resources.

(ii) The speed of scale removal can be easily controlled by adjusting the current density used for the removal of scale. Thus, this speed can be heightened suitably.

(iii) Since aqueous solutions of neutral salts are used for the electrolytic reaction involved, the waste liquid emanating from the treatments can be disposed of easily.

(iv) The line for scale removal is simple and the place required for the installation of the equipment is small.

What is claimed is:

1. A method for the removal of scale from hot rolled steel, which comprises subjecting said steel covered with scale to anode electrolysis in an aqueous 5 to 20% sodium sulfate solution at a current density in the range of 0.2 to 1.2 A/cm$^2$ for a period of 30 to 60 seconds, and then subjecting said steel resulting from said anode electrolysis to anode electrolysis in an aqueous 5 to 20% sodium chloride solution at a current density in the range of 0.3 to 0.5 A/cm$^2$ for a period of 30 to 60 seconds.

2. The method of claim 1, wherein said steel is SUS 304 steel or SUS 430 steel.

3. The method of claim 1, wherein said scale contains magnetite, wustite, and chromium sesquioxide.

4. The method of claim 1, wherein the two treatments of anode electrolysis are carried out at temperatures in the range of 20° C. to 80° C.

* * * * *